US007159258B2

(12) United States Patent
Huang

(10) Patent No.: US 7,159,258 B2
(45) Date of Patent: Jan. 9, 2007

(54) REPLACEABLE BEDDING STRUCTURE

(76) Inventor: Wen Ching Huang, 3F., No. 134, Sec.2, Jhongcheng Rd., Shihlin District, Taipei City 111 (TW)

( * ) Notice: Subject to any disclaimer, the term of this patent is extended or adjusted under 35 U.S.C. 154(b) by 179 days.

(21) Appl. No.: 10/773,240

(22) Filed: Feb. 9, 2004

(65) Prior Publication Data

US 2005/0172410 A1 Aug. 11, 2005

(51) Int. Cl.
*A47C 20/00* (2006.01)
*A47C 16/00* (2006.01)
*A47G 9/02* (2006.01)

(52) U.S. Cl. ..... 5/636; 5/652.1; 5/486; 5/490

(58) Field of Classification Search ..... 5/652.1, 5/638, 636, 486, 488, 489, 490, 652; 297/452.42, 297/452.43, 452.46, 452.47
See application file for complete search history.

(56) References Cited

U.S. PATENT DOCUMENTS

| | | | | | |
|---|---|---|---|---|---|
| 823,929 | A * | 6/1906 | Coakley | 5/490 |
| 1,532,400 | A * | 4/1925 | Grafe | 297/452.43 |
| 1,664,636 | A * | 4/1928 | Augustine | 297/180.11 |
| 2,551,741 | A * | 5/1951 | Hopper | 297/452.43 |
| 2,789,292 | A * | 4/1957 | Budinquest | 5/486 |
| 3,069,203 | A * | 12/1962 | Propus | 297/452.43 |
| 4,309,784 | A * | 1/1982 | Cohen | 5/639 |
| 4,324,012 | A * | 4/1982 | Cannaday | 297/452.43 |
| 5,111,544 | A * | 5/1992 | Graebe | 5/654 |
| 5,144,911 | A * | 9/1992 | Moore et al. | 119/28.5 |
| 5,333,930 | A * | 8/1994 | Glenn | 297/219.11 |
| 6,032,308 | A * | 3/2000 | Chuang | 5/502 |
| 6,182,315 | B1 * | 2/2001 | Lee | 5/690 |
| 6,928,675 | B1 * | 8/2005 | Hamilton | 5/490 |
| 2004/0075310 | A1 * | 4/2004 | Wang | 297/184.11 |
| 2004/0187210 | A1 * | 9/2004 | Hickman | 5/482 |
| 2005/0150048 | A1 * | 7/2005 | Hamilton | 5/490 |

* cited by examiner

*Primary Examiner*—Michael Safavi
(74) *Attorney, Agent, or Firm*—Rosenberg, Klein & Lee

(57) ABSTRACT

A replaceable bedding structure for double uses in winter and summer mainly includes a bottom cover which has an opening with a coupling section located on the periphery thereof. The upper cover has a connecting section corresponding to the coupling section and a plurality of spaced blocks. Users can rapidly change and replace the upper cover according to seasonal reasons and personal preference. Thus the practicality and versatility of the bedding goods are improved. Moreover, the blocks are spaced to form passages there between to enhance air ventilation. As a result, air permeability and comfort of the bedding goods are also improved.

2 Claims, 5 Drawing Sheets

REPLACEABLE BEDDING STRUCTURE

BACKGROUND OF THE INVENTION

1. Field of the Invention

This invention relates to bedding, more particularly to a replaceable bedding structure that is adaptable for using in winter and summer.

2. Description of the Related Art

There are a wide variety of bedding goods such as pillows, beds and the like. In order to be pleasing to the eyes, it is known to add a cover on the bedding. Take the commonly used pillow as an example, it can be classified as a hard pillow and a soft pillow. Referring to FIG. 1, a hard pillow 1 generally includes a body 11 and a cover 12 for encasing the body 11. The cover 12 is made from woven rattan, bamboo and the like. It has good air permeability and can help in dispersing body heat from the head 10 to soothe users without excessive sweating or sweltering. It is more suitable for using in summer. However, it is not suitable for using in winter when the weather is cold. As a result, its applicability is limited. These covers cannot be changed in accordance with the changing weather from season to season. Meanwhile, the hard pillow made of hard material is not universally acceptable to all users.

Referring to FIG. 2, a soft pillow 2 mainly includes a body 21 filled with a soft material (such as cotton) and a cover 22 for encasing the body 21. The cover 22 is mainly made of fabrics. Therefore, the soft pillow 2 is more suitable for using in winter. Due to the fact that the weather is cold in the winter, the soft pillow 2 helps to keep body warm. However, during summer time, using it can accelerate perspiration of user's head 20. The perspiration seeps into the cover 22 and body 21. Besides creating stains on the cover 22, it also generates bad smell of sweat.

In addition to the aforesaid concerns attributed to the pillow 1 or 2, such as comfort, being nice and cool, cleaning of sweat stains and removing of sweat smell, every user generally has to prepare two sorts of pillows to meet the requirements of seasonal changes. The single function of the presently known pillows often are inconvenient. Moreover, cover replacement for the soft pillow 2 is often limited to pattern alterations. It does not have much versatility. There is still room for improvement.

SUMMARY OF THE INVENTION

Therefore, the object of the present invention is to provide a replaceable bedding structure that is usable in winter and summer to improve practicality, versatility and convenience.

According to this invention, it includes a body and a cover encasing the body. The cover has a bottom cover and an upper cover coupled to the bottom cover. The bottom cover has an opening which has a coupling section on the periphery thereof. The upper cover has a plurality of spaced blocks and a connecting section corresponding to the coupling section. Hence the upper cover and the bottom cover may be coupled though the coupling section and the connecting section to facilitate replacement of the upper cover depending on different seasons, thereby enhancing the practicality and versatility of the bedding. The blocks on the upper cover are laid and spaced from one another so that there is a passage between any two neighboring blocks to provide ventilation air and improve air permeability and comfort in use.

BRIEF DESCRIPTION OF THE DRAWINGS

The accompanying drawing figures are included to provide a further understanding of the invention, and are incorporated in and constitute a part of this specification. The drawings illustrate an embodiment of the invention and, together with the description, serve to explain the principles of the invention. In the drawing.

DETAILED DESCRIPTION OF THE PREFERRED EMBODIMENTS

Figure 1:
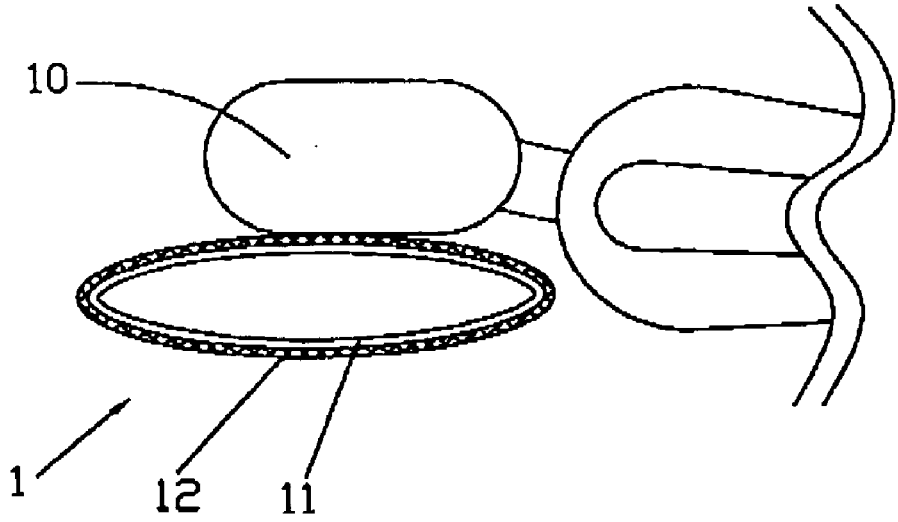
FIG.1 (PRIOR ART)
FIG. 1 is a schematic view of a conventional hard pillow in use.
Figure 2:
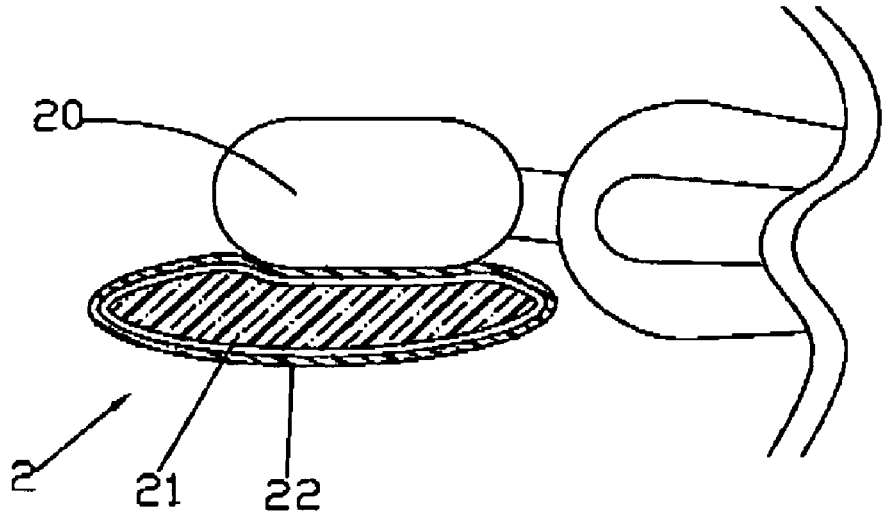
FIG.2 (PRIOR ART)
FIG. 2 is a schematic view of a conventional soft pillow in use.

Reference will now be made in detail to the preferred embodiments of the present invention, examples of which are illustrated in the accompanying drawings. Wherever possible, the same reference numbers are used in the drawings and the description to refer to the same or like parts.

Figure 3:
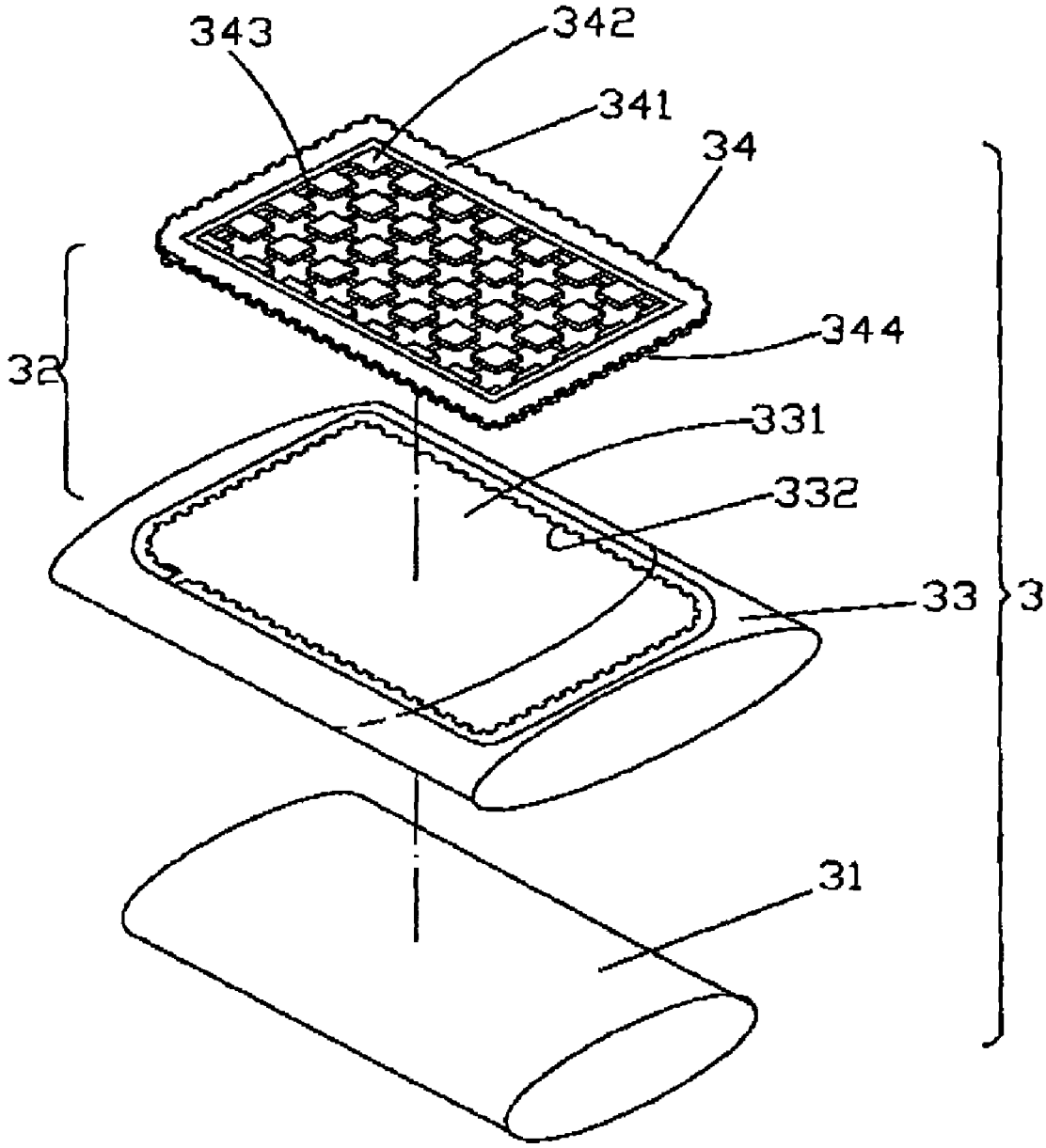
FIG. 3 is an exploded, perspective view illustrating a pillow according to the present invention.
Figure 4:
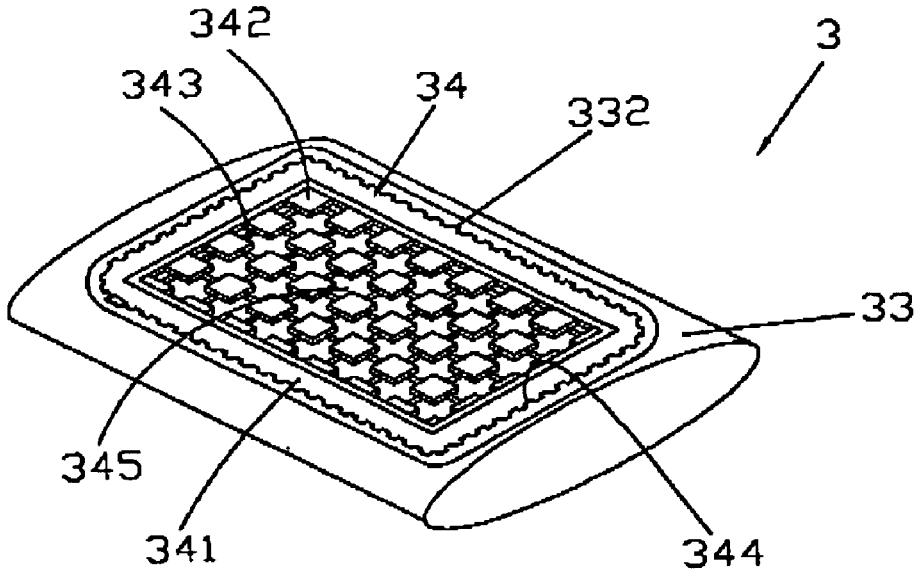
FIG. 4 is a perspective view of the pillow according to the present invention.

Referring to FIGS. 3 and 4, there is shown an embodiment of a replaceable bedding structure 3 for winter and summer use according to the invention. It mainly includes a body 31 and a cover 32 for encasing the body 31. The body 31 in this embodiment is a pillow which is a solid substance filled with a foamed material.

Figure 5:
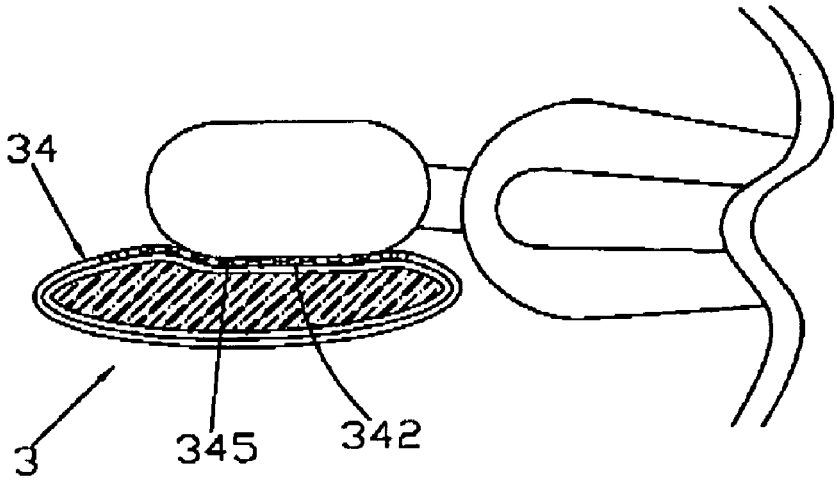
FIG. 5 is a schematic view illustrating a cross-section of the pillow while in use, according to the present invention.

Additionally referring to FIG. 5, the cover 32 has a bottom cover 33 and an upper cover 34 coupled to the bottom cover 33. The body 31 may be encased in the bottom cover 33. The bottom cover 33 has an opening 331 which has a coupling section 332 on the periphery. In this embodiment, the coupling section 332 is a zipper. The upper cover 34 has a base 341, a plurality of spaced blocks 342 laid on the base 341 with each block 342 interconnected by connection threads 343, and a connecting section 344 located on the outer periphery of the base 341. The blocks 342 are made of flat bamboos or spherical balls and the like. Only flat bamboos are shown in the drawings. The connecting section 344 (a zipper is used in this embodiment) is located on a position corresponding to the coupling section 332 for engaging with each other so that the upper cover 34 and the bottom cover 33 are coupled to encase the body 31.

Referring to FIGS. 4 and 5, when in use, as the pillow is filled with a foamed material, it is soft and more acceptable to general users. As the upper cover 34 is coupled through a zipper, it is easier and faster to be changed. Thus practicality and versatility of the bedding can be improved to overcome the shortcoming of less versatility of the conventional pillow 1 (or 2). Users can replace the required upper cover 34 according to seasonal reasons or personal preference, such as a plain fabric material (not shown in the drawings) which can be used in winter for warming, and the upper cover 34 with a plurality of blocks 342 can be used in summer for cooling. The spaced blocks 342 on the upper cover 34 and passages 345 formed between two neighboring blocks 342 enable the pillow to compress as desired when in use. The passages 345 can further provide ventilation air to improve air permeability and comfort when people lie thereon.

Figure 6:
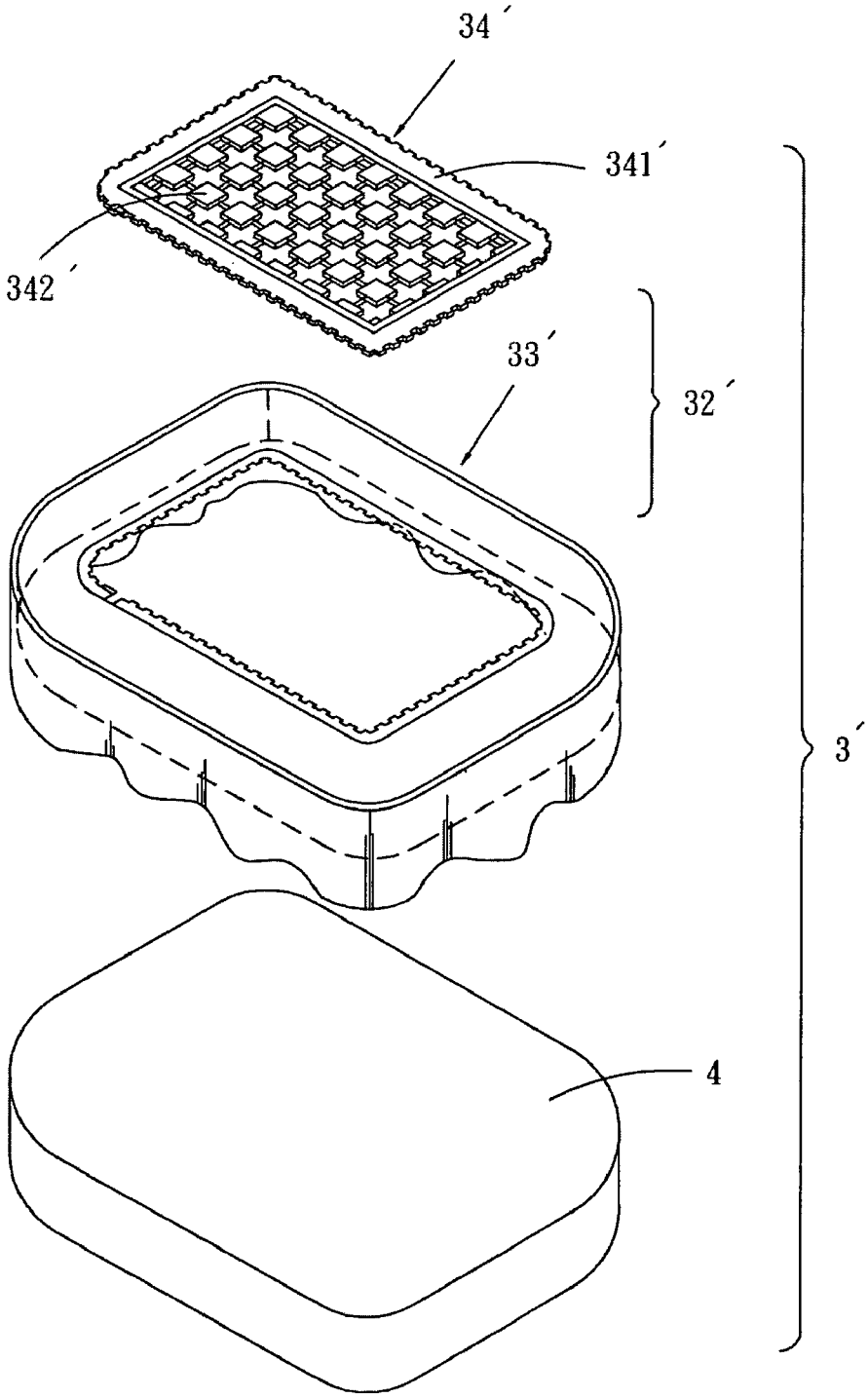
FIG. 6 is an exploded, perspective view illustrating an application of the present invention on a bed.

Referring to FIG. 6, another embodiment of the replaceable bedding structure according to the invention is shown. It has a body 4 encased by a cover 32'. The cover 32', besides changes of dimension and appearance, has a base 341' and blocks 342' located thereon in a spaced manner as the previous embodiment. Thus details are omitted. It is to be noted that the body 4 of this embodiment is a mattress for use on a bed containing a spring (not shown in the drawing).

Figure 7:
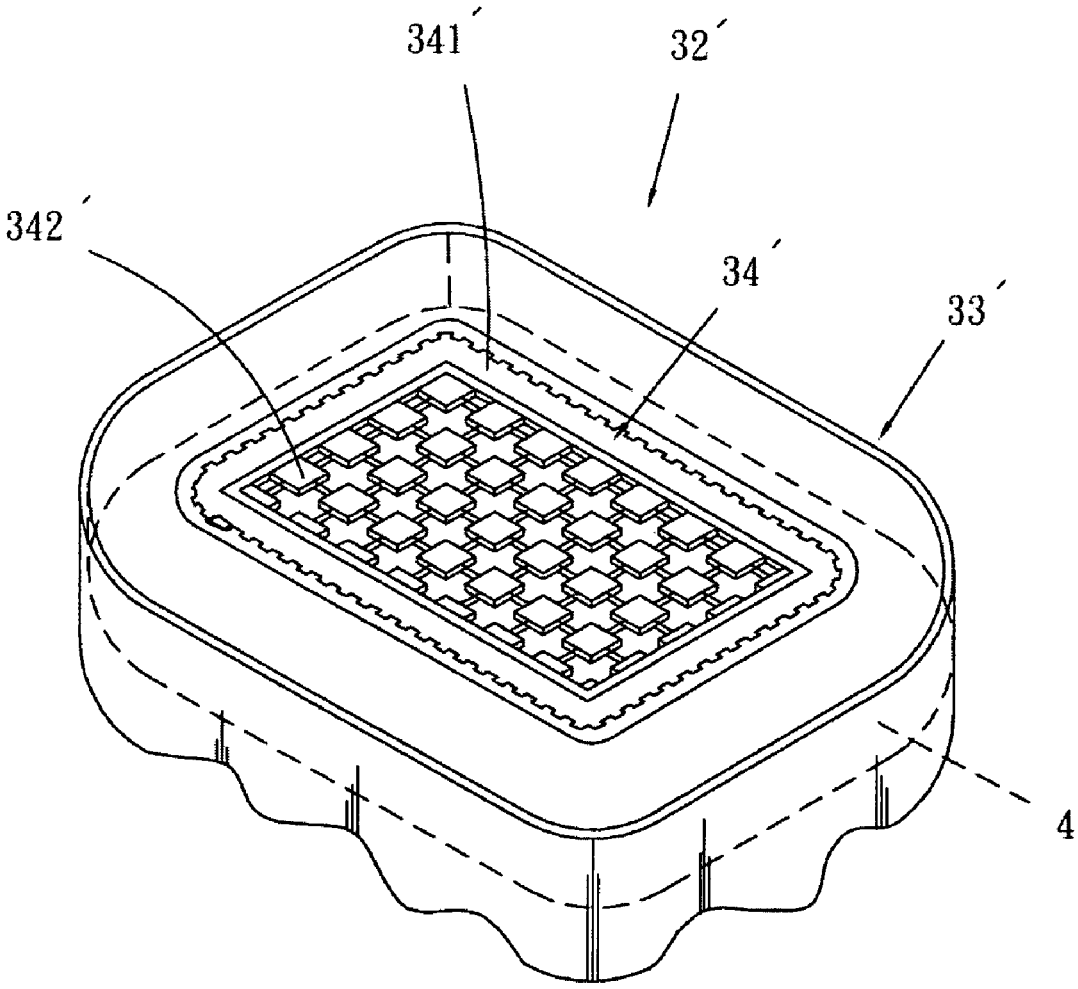
FIG. 7 is a perspective view of the bed including the replaceable bedding structure according to the present invention.

Referring to FIG. 7, when in use, the connecting section 344' of the upper cover 34' can be coupled with the coupling section 332' of the bottom cover 33'. Thus it is convenient, and the upper cover 34' can be replaced by personal preference. It is more versatile and can overcome the shortcoming of limited adaptability of the conventional bedcover. Moreover, when it is hot in the summer, the upper cover 34' can be replaced by the one made of bamboo to improve air permeability and comfort. In the winter when the weather is cold, the upper cover 34' can be changed to the one made of fabrics to maintain a warm temperature. Thus it has a greater practicality. And people do not have to prepare one bedcover for winter and another bedcover for summer. It solves the shortcoming of the general bedcover that has only a single function.

In summary, the replaceable bedding structure is adaptable for use in winter and summer according to the invention. It provides a bottom cover and an upper cover that can be coupled to encase the body. By engaging the coupling section of the bottom cover and the connecting section of the upper cover, a greater versatility, practicality and convenience may be achieved for use in a plurality of bedding goods such as pillows, beds or sitting pads.

Consequently, the present invention is described in connection with what is considered the most practical and preferred embodiments. It is understood that this invention is not limited to the disclosed embodiments but is intended to cover various arrangements included within the spirit and scope of the broadest interpretations and equivalent arrangements.

I claim:

1. A replaceable bedding structure for use in both winter and summer, comprising:

a body defined by a pillow formed of a foamed material; and a cover encasing the pillow and having a bottom cover and a upper cover releasably coupled to the bottom cover;

wherein the bottom cover has an opening and a coupling section located on a periphery of the opening, the upper cover having a base, a plurality of spaced blocks being laid on the base and interconnected by connection threads extending therebetween, the upper cover having a connecting section located on an outer periphery of the base to engage with the coupling section so that the upper cover and the bottom cover are coupled to encase the pillow, the connecting section of the upper cover and the coupling section of the bottom cover being defined by a zipper.

2. The replaceable bedding structure of claim 1, wherein the blocks are flat pieces of bamboo.

* * * * *